US006708408B2

(12) United States Patent
Orloff

(10) Patent No.: US 6,708,408 B2
(45) **Date of Patent: *Mar. 23, 2004**

(54) RAZOR SYSTEM WITH WORN BLADE INDICATOR

(75) Inventor: Glennis J. Orloff, Woodbridge, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/218,828

(22) Filed: Aug. 14, 2002

(65) Prior Publication Data

US 2002/0189102 A1 Dec. 19, 2002

Related U.S. Application Data

(62) Division of application No. 09/047,632, filed on Mar. 25, 1998, now Pat. No. 6,460,251.

(51) Int. Cl.[7] ..... B26B 19/43
(52) U.S. Cl. ..... 30/41.7; 30/34.05
(58) Field of Search ..... 30/41.7, 34.05, 30/526

(56) References Cited

U.S. PATENT DOCUMENTS

| | | | | |
|---|---|---|---|---|
| 3,631,595 A | | 1/1972 | Scott et al. | |
| 3,879,844 A | | 4/1975 | Griffiths | |
| 4,380,121 A | | 4/1983 | Naimer et al. | |
| 5,111,580 A | | 5/1992 | Bosscha et al. | |
| 5,146,680 A | | 9/1992 | Bakhos | |
| 5,165,170 A | | 11/1992 | Sagol et al. | |
| 5,240,107 A | | 8/1993 | Casale | |
| 5,347,715 A | | 9/1994 | Friedland | |
| 5,388,331 A | | 2/1995 | Doroodian-Shoja Siamak | |
| 5,500,635 A | | 3/1996 | Mott | |
| 5,600,888 A | | 2/1997 | Becker | |
| 5,671,535 A | | 9/1997 | Van Der Borst et al. | |
| 5,789,844 A | | 8/1998 | de Groot | |
| 6,460,251 B1 | * | 10/2002 | Orloff | 30/41.7 |

FOREIGN PATENT DOCUMENTS

| | | |
|---|---|---|
| EP | 0 906 814 B1 | 7/2001 |
| FR | 2 726 925 | 5/1996 |

* cited by examiner

*Primary Examiner*—M. Rachuba
(74) *Attorney, Agent, or Firm*—McCormick, Paulding & Huber LLP

(57) ABSTRACT

The present invention is directed to a shaving system having an indicator for indicating when the blades are becoming dull and in need of replacement. As razor blades dull, the user must exert greater force during shaving to achieve a satisfactory shave. Upon exertion of this extra force, a piston which is adjacent to the blades moves away from the blades in response to the increased forces encountered by the blades during shaving. Upon moving a sufficient distance, the piston activates a sensor, such as a potentiometer, which initiates a signal processing circuit which in turn activates an indicator, such as a light-emitting diode. The activation of the indicator is a signal to the user to replace the blades.

36 Claims, 5 Drawing Sheets

RAZOR SYSTEM WITH WORN BLADE INDICATOR

CROSS-REFERENCE TO RELATED APPLICATION

This application is a division from U.S. non-provisional application Ser. No. 09/047,632 filed on Mar. 25, 1998 is now U.S. Pat. No. 6,460,251.

BACKGROUND OF THE INVENTION

1. Field of the Invention

This invention relates to the placement of one or more in-situ sensors in razor systems to provide an indication that the razor blade or blades are worn and in need of replacement.

2. Description of Related Art

Efforts to improve shave quality have been on-going for many years. One method of improving shave quality is to ensure that the blades are used for the proper number of shaves and are replaced once they become dulled. The use of dull blades during shaving can cause pulling and tearing, instead of clean cutting, of the hair. This can cause a poor and uncomfortable shave to result. Several prior attempts to provide a system which would keep track of the usage of blades have been made. For example, U.S. Pat. No. 5,240,107 discloses a razor holder having a shave counter which displays a number. The shave counter is activated by the placement of a razor in the holder. Such placement advances a number on the holder so that theoretically the user can have a record of the number of shaves with each set of blades. An inherent problem with such a system is that there is no direct correlation between the wear on the blades and the number of placements in a holder, and thus the number displayed on the shave counter is meaningless for indicating the actual blade wear. Among other prior attempts to provide an indicator for blade wear is U.S. Pat. No. 5,388,331 which discloses a wear indicator which abrades away to indicate that the blades are worn. One inherent problem with this system is that there is no direct correlation between the speed of abrasion of the wear indicator and the actual wear of the blade and thus no guarantee that the wear indicator will not abrade faster or slower than the blade wears.

It would be advantageous to provide a razor system which depends upon actual shaving force, and not extraneous functions, to indicate razor blade wear Accordingly, it is an objective of the present invention to provide a razor system having an electronic sensing means which respond to the forces on the blades during shaving to provide an automatic signal when the blades are dull and in need of replacement

SUMMARY OF THE INVENTION

The present invention is directed to a wet shaving system having an electronic indicator for indicating when the blades are becoming dull and in need of replacement. As razor blades dull, the user must exert greater force during shaving to achieve a satisfactory shave. The forces exerted during shaving are transmitted to a piston which is adjacent to the blades and moves in response to the increased forces encountered by the blades. Upon moving, the piston pushes into an electronic sensing device, such as a potentiometer, which records the change in force as a change in resistance which is transmitted to a signal processing circuit which in turn is connected to an indicator, such as a light-emitting diode. Upon reaching a resistance denoting the exertion of extra force, the indicator is activated to signal the user to replace the blades. In a further embodiment, the piston pushes into an electronic sensing device, such as a switch, upon moving a sufficient distance which engages the signal processing circuit and activates the indicator. As with the prior embodiment, the activation of the indicator is a signal to the user to replace the blades.

DETAILED DESCRIPTION OF THE PREFERRED EMBODIMENTS

Reference will now be made to the presently preferred embodiments of the invention. For the purpose of this application, wet shave razors are defined to be razors which are customarily utilized in conjunction with soap or shaving cream or gels and hot water. The definition of wet shave razors includes both disposable razors, in which the user discards the entire unit after a certain number of uses, and permanent systems, with which the user discards and replaces the razor cartridge after a certain number of uses. In both instances, the razor head, or cartridge, is the portion which surrounds and contains the blade or blades. The combination of the razor head and the handle, either permanent or disposable, is defined as the razor system. Further, the definition of potentiometer includes devices which are also commonly known as variable resistors.

The present invention provides for a wet shave razor system which contains an insitu sensor to identify when the blade or blades are worn and in need of replacement. Sharp blades are critical for providing a close, comfortable shave and require the user to exert only a minimum of pressure upon the blades during shaving. The pressure required by the user is exemplified by the user "pushing" down on the razor during shaving. When the blades become dulled, the user must push down harder on the razor to exert additional pressure in order to compensate for the dullness in order to produce a satisfactory shave. The increase in the applied pressure by the user is measurable by a sensor, such as a potentiometer or a switch which is capable of working in concert with additional elements of a razor to provide an indication to the user that he or she is using increased pressure during shaving, and that the blades need replacement.

Figure 1:
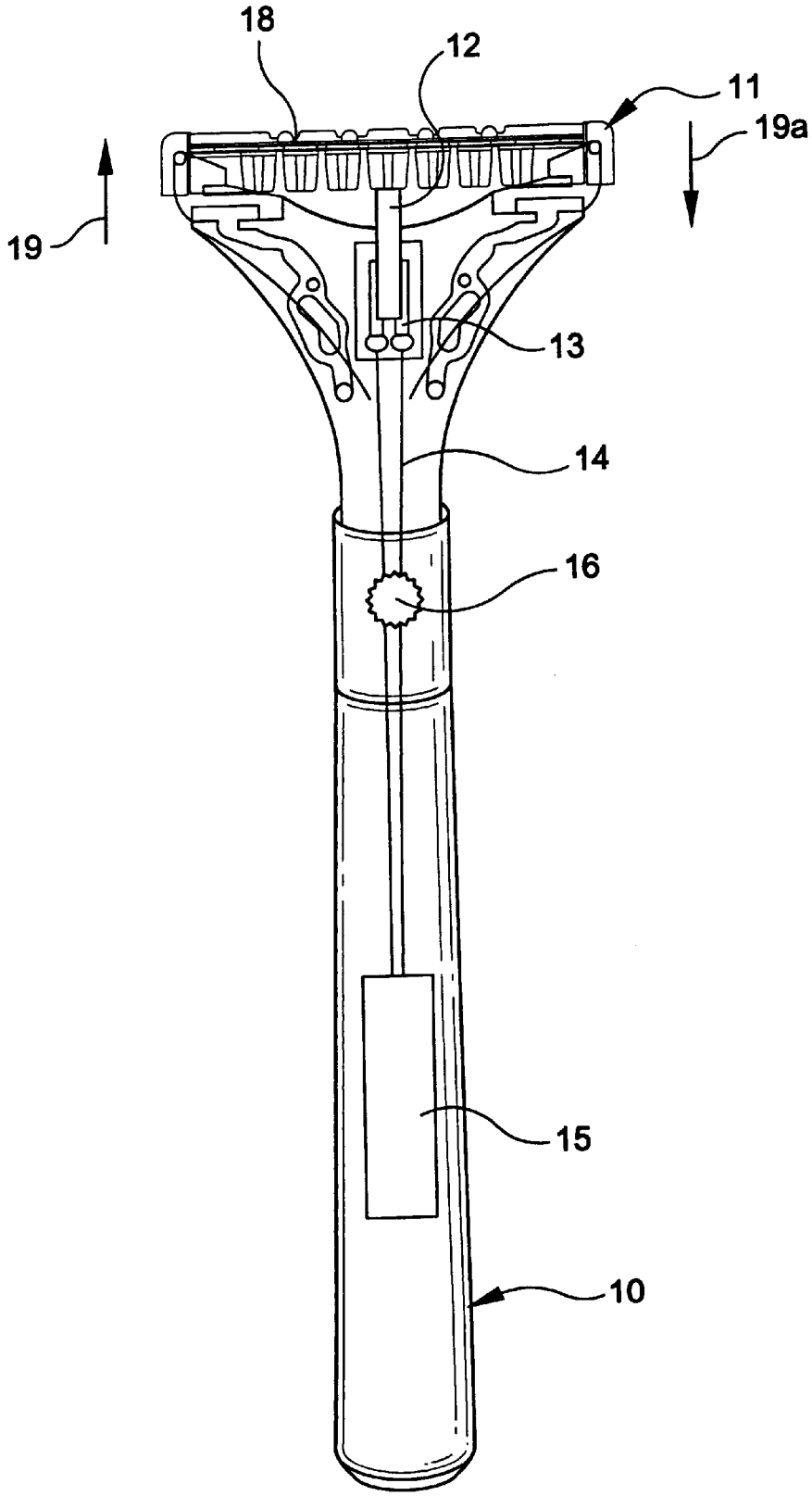
FIG. 1 is a cut-away top view of a razor having an indicator utilizing a carbon track and a conductive metal track on a ceramic or polymer substrate and a conductive metal spring.
Figure 2:
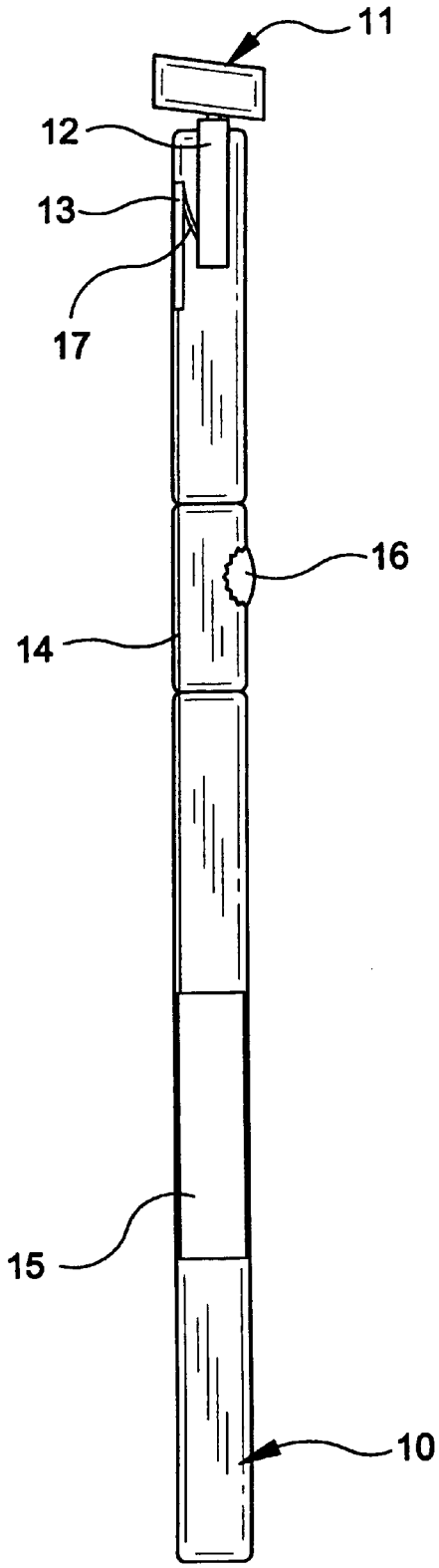
FIG. 2 is a cut-away side view of the razor of FIG. 1.

FIGS. 1 and 2 illustrate one preferred embodiment of the present invention. Cartridge 11, illustrated with two blades 18 but capable of having one, three or more blades, is attached to handle 10. The cartridge, the blade(s) or some combination thereof must be flexible in response to forces encountered during shaving. Piston 12 extends outward from the handle to a point where one end of the piston is adjacent to, and if desired in contact with, the back of the cartridge or blade(s). In order to obtain the optimal indication of the force on the razor it is preferable to place the piston substantially in the center of the razor. The end of the piston opposite to the cartridge is within the razor head and positioned over a wire wound core, cermet or most preferably a carbon track on a ceramic or polymer substrate 13. A conductive metal spring wiper 17 extends from the piston and makes contact with the carbon track and a conductive metal track on the substrate 13 Wires 14 extend from the carbon track and the conductive metal track on the substrate 13 to a signal processing circuit which is preferably located within the handle 10. An indicator, preferably in the form of light-emitting diode 16 is located at some point on the handle.

One of the major shaving forces is the pressure applied by the user in order to obtain a close shave. As the blades become dull through use, the user must apply increased pressure in direction 19 in order to achieve a close shave. The increased pressure causes the blades and/or cartridge to flex in direction 19*a* which in turn causes the piston 12 to move in direction 19*a*. Movement of piston 12 causes wiper 17 to move along the carbon track on the substrate 13. This movement creates a change in electrical resistance which is communicated to signal processing circuit 15 via wires 14. The signal processing circuit utilizes the resistance change to activate an indicator, such as light-emitting diode 16

The signal processing circuit may activate the indicator to illustrate that the blades are in need of replacement in various manners For example, the signal processing circuit may activate the indicator for a period of time and then turn it off at a certain point, such as the commencement of the next shave. The signal processing circuit may also leave the indicator on indefinitely or cause it to repeatedly blink off and on. The signal processing circuit may also be used simultaneously to provide an indication to the user that too much or too little pressure is being applied by the user to the face during the shave, as described in co-pending U.S. patent application Ser. No. 08/942,527, which is incorporated herein by reference. Likewise, the indicator may be of numerous different types. In addition to the illustrated light-emitting diode, the indicator may be a light, a motor or piezoelectric transducer to produce a motion, such as vibration, or a circuit board or solid state chip which produces an audible sound, such as notes of a song and/or a human-like voice when the applied pressure indicates that the blades are in need of replacement.

Figure 3:
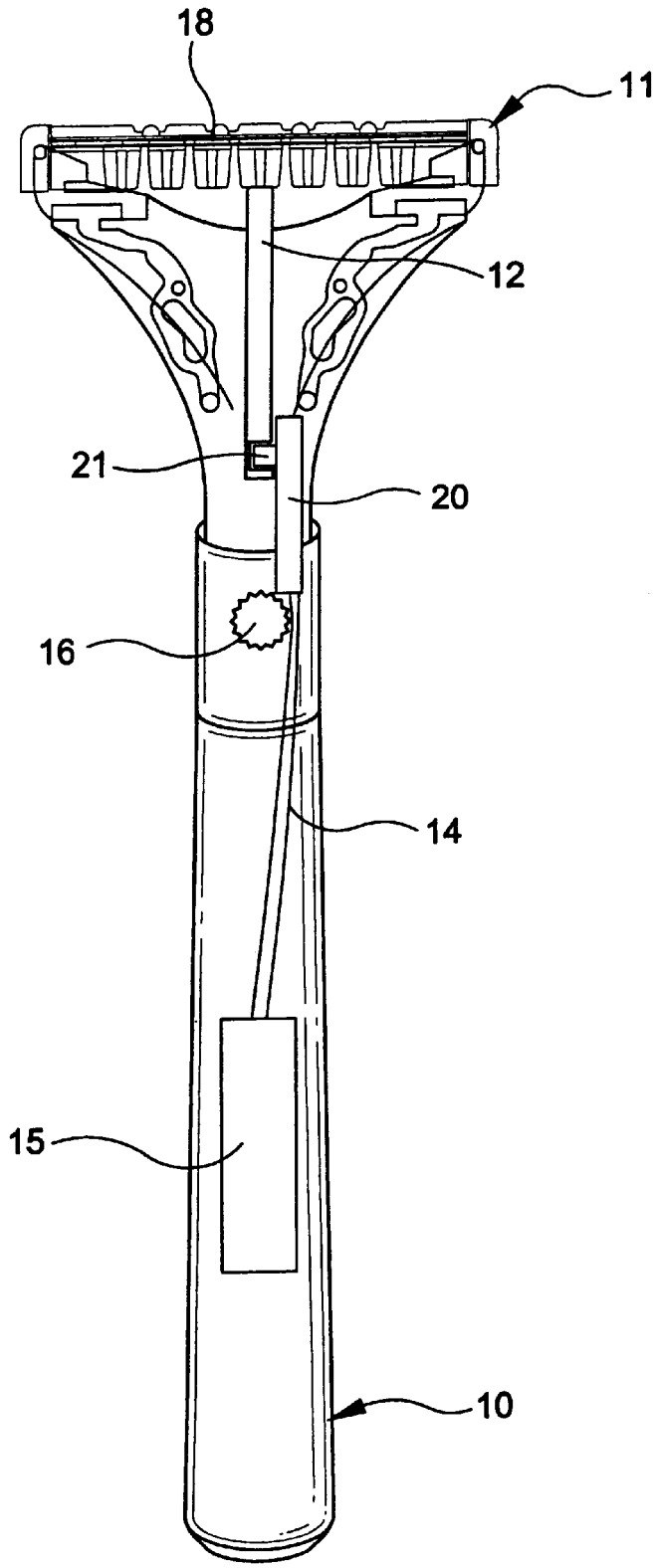
FIG. 3 is a cut-away top view of a razor having an indicator utilizing a linear potentiometer.
Figure 4:
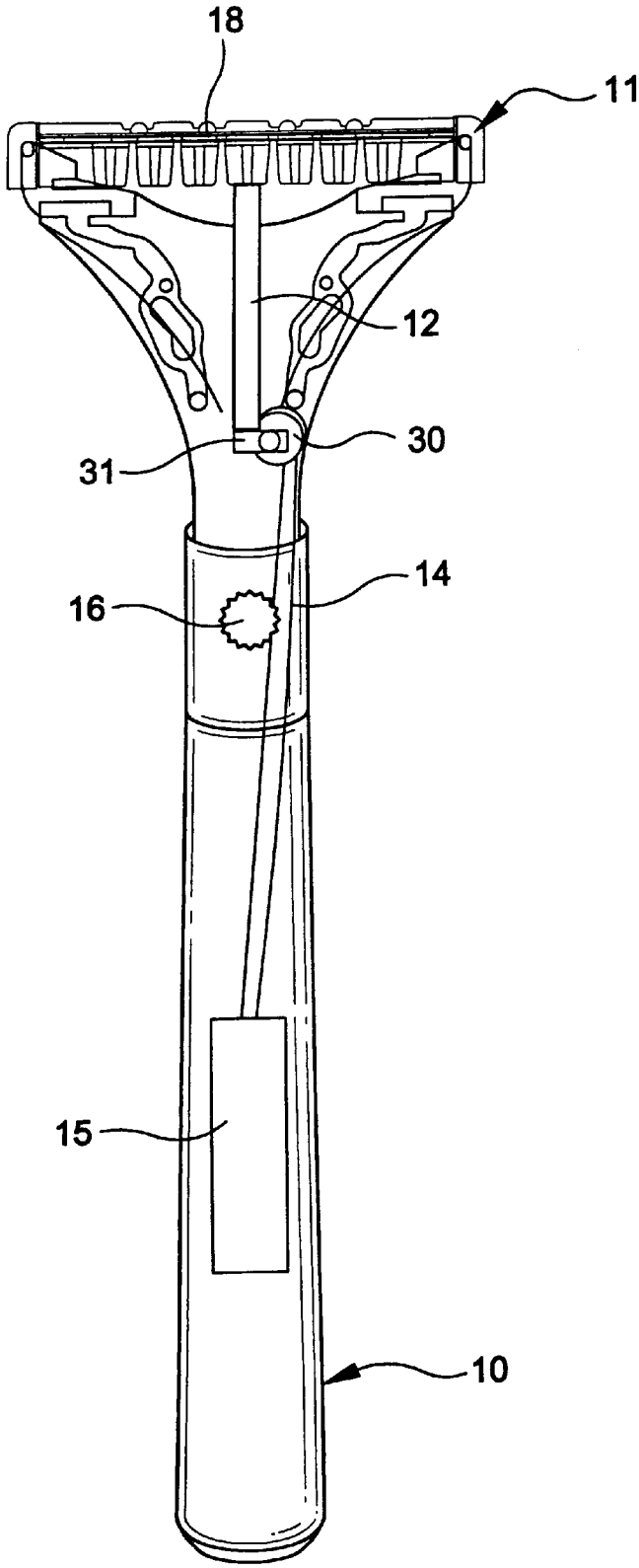
FIG. 4 is a cut-away top view of a razor having an indicator utilizing a potentiometer.

The point of activation may be preset within the signal processing circuit to a specific resistance that translates to a pre-set pressure. A factory setting based on the amount of pressure applied by the average user when the razor blades are in need of replacement may be applied. In a further embodiment, a dial which is set to determine the pressure required for the activation of the indicator may be employed. For example, the dial would be set to a high pressure setting when the razor is being used to shave heavier beards which normally require additional applied shaving pressure, while the dial would be set at a low pressure setting for shaving sensitive skin. A still further embodiment obligates the signal processing circuit to monitor the amount of pressure applied to the razor following the initial shave with new blade(s) and then determine through calculation the amount of pressure that would be applied when the razor blade(s) needed to be replaced. This application would require the attachment of the new blade(s) to trigger the signal processing circuit to record and determine the initial shaving pressure applied to the razor blade(s). From the initial shaving pressure measurements, a pressure in which one or more of the blades is worn and in need of replacement is calculated and used to activate the indicator Further alternative embodiments of the razor system of the present invention comprising a potentiometer are illustrated in FIGS. 3 and 4. The potentiometer detects changes in the forces translated via the piston 12. Movement of the potentiometer shaft via a translation, as in a linear potentiometer, or rotation, as in a potentiometer, results in a change in resistance indicative of the forces applied by the user. Changes in resistance may be converted into an equivalent voltage change and utilized to activate the indicator which, as in the previous embodiments, may provide numerous different forms of light, sound or motion. In the embodiment of FIG. 3, linear potentiometer 20 is located in handle 10. Potentiometer shaft 21 of the linear potentiometer receives forces from the blades 18 through the cartridge 11 via piston 12. The change in resistance resulting from the movement of the potentiometer shaft along the linear potentiometer is converted by the signal processing circuit 15 into an equivalent voltage change and utilized to activate an indicator 16. In the embodiment of FIG. 4, a potentiometer 30 is located in handle 10. Forces applied during shaving are translated via piston 12 to lever 31 and then onto potentiometer shaft 30 As with the previous embodiment, the translation of forces will cause the potentiometer to produce a resistance change which is converted to an equivalent voltage and utilized to activate the indicator in response to the applied shaving forces. This activation provides an indication to the user that he or she is applying increased pressure during shaving and that the blades should be replaced so that the applied pressure may be reduced.

Figure 5:
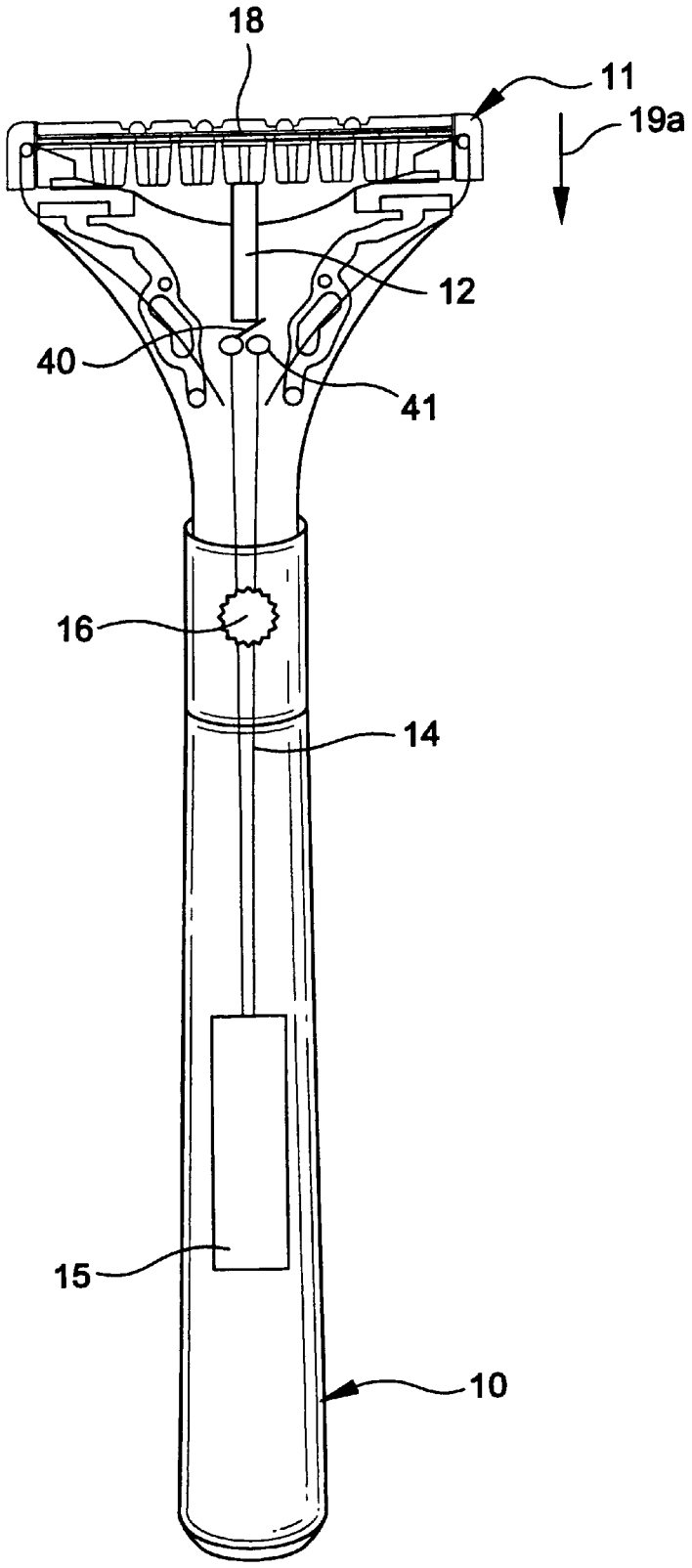
FIG. 5 is a cut-away top view of a razor having an indicator utilizing a switch contact and a switch arm.

FIG. 5 illustrates a further alternative preferred embodiment of the present invention. In this embodiment switch arm 40 and switch contact 41 are located within handle 10 In response to forces encountered during shaving the piston moves in direction 19*a* and thus contacts and pushes switch arm 40. When sufficient force is produced the switch arm will be moved into contact with switch contact 41 and thereby close the signal processing circuit causing the activation of the indicator As with the previous embodiments, the activator may provide many different forms of indication that the blades are in need of replacement. The switch arm may be preset at any desired stiffness depending on the force at which the user desires the activation of the indicator. In a preferred embodiment the switch arm has a constant stiffness but may be set at different positions which each require a different force to activate the indicator. For example, in the situation where the user desires the activation of the indicator when the blades are only slightly worn the switch arm would be set such that a minimum of pressure from the piston would move the switch arm to close the circuit and activate the indicator.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A razor system comprising a razor head having one or more blades, a handle, a movable piston having a first end located adjacent to the razor head and a second end located within the handle, and a sensing means located adjacent to the second end of the piston, wherein the one or more blades, the razor head or a combination thereof are flexible and the sensing means responds to forces encountered during shaving which are communicated to the sensing means through the piston from the one or more blades, the razor head, or both.

2. A razor system according to claim 1, further comprising a signal processing circuit in communication with the sensing means.

3. A razor system according to claim 2, further comprising an indicator in communication with the signal processing circuit.

4. A razor system according to claim 3, wherein the sensing means includes a potentiometer.

5. A razor system according to claim 4, wherein the sensing means further comprises at least one of a wire wound core, a cermet, a carbon track, a conductive metal track on a ceramic substrate, and a conductive metal track on a polymer substrate.

6. A razor system according to claim 3, wherein the signal processing circuit produces a response to the indicator which provides an indication that a user is utilizing increased applied pressure during shaving and that the one or more blades are dull and in need of replacement.

7. A razor system according to claim 3, wherein the indicator includes at least one of a light-emitting diode, a light, a sound producing device, and a motion producing device.

8. A razor system according to claim 7, wherein the razor head is permanently attached to the handle.

9. A razor system according to claim 7, wherein the razor head is removably attached to the handle.

10. A razor system according to claim 3, wherein the sensing means comprise a potentiometer and lever, wherein the lever is located proximate the second end of the piston.

11. A razor system according to claim 10, wherein forces encountered during shaving cause one of the razor head, the one or more blades, or both, to flex in the direction of the handle, causing the piston to slide into contact with the lever in the handle, and the lever to communicate the force to the potentiometer which change is communicated as an electrical signal to the signal processing circuit.

12. A razor system according to claim 11, wherein the signal processing circuit transmits a response to the indicator which provides an indication that a user is utilizing increased applied pressure during shaving and that the one or more blades are dull and in need of replacement.

13. A razor system according to claim 12, wherein the indicator includes at least one of a light-emitting diode, a light, a sound producing device and a motion producing device.

14. A razor system according to claim 13, wherein the razor head is permanently attached to the handle.

15. A razor system according to claim 13, wherein the razor head is removably attached to the handle.

16. A razor system according to claim 3, wherein the sensing means comprise a linear potentiometer with a shaft, wherein the potentiometer shaft is located proximate the second end of the piston.

17. A razor system according to claim 16, wherein forces encountered during shaving cause one of the razor head, the one or more blades, or both, to flex in the direction of the handle, the piston to slide into contact with the potentiometer shaft in the handle, and the potentiometer shaft to communicate the force to the linear potentiometer which change is communicated as an electrical signal to the signal processing circuit.

18. A razor system according to claim 17, wherein the signal processing circuit transmits a response to the indicator which provides an indication that a user is utilizing increased applied pressure during shaving and that the one or more blades are dull and in need of replacement.

19. A razor system according to claim 18, wherein the indicator includes at least one of a light-emitting diode, a light, a sound producing device, and a motion producing device.

20. A razor system according to claim 19, wherein the razor head is permanently attached to the handle.

21. A razor system according to claim 19, wherein the razor head is removably attached to the handle.

22. A razor system according to claim 3, further comprising a means for adjusting the amount of shaving force required to cause the sensing means to respond to the forces encountered during shaving.

23. A razor system according to claim 3, wherein the sensing means comprise a switch arm and a switch contact located adjacent to the second end of the piston.

24. A razor system according to claim 23, wherein forces encountered during shaving cause one of the razor head, the one or more blades, or both, to flex in the direction of the handle, the piston to slide into contact with the switch arm in the handle, and the switch arm to swing and come into contact with the switch contact to form an electrical circuit between the switch arm, the switch contact, and the signal processing circuit.

25. A razor system according to claim 24, wherein the signal processing circuit sends an electrical signal to the indicator which provides an indication that a user is utilizing increased applied pressure during shaving and that the one or more blades are dull and in need of replacement.

26. A razor system according to claim 25, wherein the switch arm comprises more than one position or more than one stiffness such that different forces are required to cause the switch arm to swing into contact with the switch contact.

27. A razor system according to claim 26, wherein the indicator includes at least one of a light-emitting diode, a light, a sound producing device, and a motion producing device.

28. A razor system according to claim 27, wherein the razor head is permanently attached to the handle.

29. A razor system according to claim 27, wherein the razor head is removably attached to the handle.

30. A razor handle having a movable piston having a first end extending out from the razor handle and a second end located within the handle, and a sensing means located adjacent to the second end of the piston, wherein the sensing means responds to forces encountered during shaving which are communicated to the sensing means through the piston from the one or more blades.

31. A razor handle according to claim 30, further comprising a signal processing circuit in communication with the sensing means.

32. A razor handle according to claim 31, further comprising an indicator in communication with the signal processing circuit.

33. A razor handle according to claim 32, wherein the sensing means comprises at least one of a potentiometer, a linear potentiometer, a cermet, a wire wound core, a switch arm and switch contact, a conductive metal spring adjacent to a carbon track, a conductive track on a ceramic substrate and a conductive track on a polymer substrate.

34. A razor handle according to claim 33, wherein the indicator includes at least one of a light-emitting diode, a light, a sound producing device, and a motion producing device.

35. A method for determining when razor blades are dull and in need of replacement, comprising the steps of:

a) providing a razor system comprising a flexible razor head having one or more blades or a razor head having one or more flexible blades, a handle, a movable piston having a first end located adjacent to the razor head and a second end located within the handle, a sensing means located adjacent to the second end of the piston, a signal processing circuit in communication with the sensing means, and an indicator in communication with the signal processing circuit;

b) providing a force which causes one of the razor head, the one or more blades, or both, to flex in the direction of the handle, the piston to slide into the handle, and the sensing means to create a change in electrical resistance based on the force;

c) communicating the change in electrical resistance to the signal processing circuit; and d) providing a response from the signal processing circuit to the indicator which provides an indication that a user is utilizing increased applied pressure during shaving and that the one or more blades are dull and in need of replacement.

36. A method for determining when razor blades are dull and in need of replacement, comprising the steps of:

a) providing a razor system comprising a flexible razor head having one or more blades or a razor head having one or more flexible blades, a handle, a movable piston having a first end located adjacent to the razor head and a second end located within the handle, a switch arm and switch contact located adjacent to the second end of the piston, a signal processing circuit in communication with the switch arm and switch contact, and an indicator in communication with the signal processing circuit;

b) providing a force which causes one of the razor head, the one or more blades, or both, to flex in the direction of the handle, the piston to slide into the handle, and the switch arm to move into contact with the switch contact and thereby close the signal processing circuit; and c) providing a response from the signal processing circuit to the indicator which provides an indication that a user is utilizing increased applied pressure during shaving and that the one or more blades are dull and in need of replacement.

* * * * *